US006095465A

United States Patent [19]

Weck et al.

[11] Patent Number: 6,095,465

[45] Date of Patent: Aug. 1, 2000

[54] STRUCTURE FOR AND METHOD OF MOUNTING AN OBJECT ON A VERTICAL SURFACE AND A LAMINATED BACKING FOR SUCH A STRUCTURE

[76] Inventors: David Weck; Steven C. Berenson, both of 1550 Bay Dr., Miami, Fla. 33141

[21] Appl. No.: 09/165,215

[22] Filed: Oct. 2, 1998

[51] Int. Cl.[7] ..... A47G 1/17; A47G 1/16; A47F 1/14

[52] U.S. Cl. ..... 248/205.3; 248/467; 248/497

[58] Field of Search ..... 248/300, 205.3, 248/467, 205.5, 497, 216.4

[56] References Cited

U.S. PATENT DOCUMENTS

| | | | |
|---|---|---|---|
| 264,947 | 9/1882 | Heyl | 48/304 |
| 2,492,411 | 12/1949 | Barnes | 248/467 |
| 3,241,795 | 3/1966 | Frye | 248/205.5 |
| 3,300,173 | 1/1967 | Kennedy, Jr. | 248/467 |
| 3,350,045 | 10/1967 | Mayers | 248/205.3 |
| 3,556,459 | 1/1971 | Summerville, Jr. | 248/497 |
| 3,884,443 | 5/1975 | McMaster | 248/467 |
| 4,003,538 | 1/1977 | Frye | 248/467 |
| 4,336,884 | 6/1982 | Hart et al. | 206/527 |
| 4,384,648 | 5/1983 | Hart et al. | 206/527 |
| 4,420,082 | 12/1983 | Bernie | 206/526 |
| 4,425,391 | 1/1984 | Wilson | 428/43 |
| 4,499,130 | 2/1985 | Questel et al. | 428/40.6 |
| 4,500,021 | 2/1985 | Bildusas | 225/49 |
| 4,619,430 | 10/1986 | Hogg | 248/467 |
| 4,693,652 | 9/1987 | Sweeney | 411/23 |
| 4,756,498 | 7/1988 | Frye | 248/205.3 |
| 4,830,558 | 5/1989 | Sweeney | 411/258 |
| 5,076,612 | 12/1991 | Nirmel | 283/67 |
| 5,121,896 | 6/1992 | Frye | 248/467 |
| 5,238,271 | 8/1993 | Nirmel | 283/67 |
| 5,269,485 | 12/1993 | Dwinell et al. | 248/216.4 |
| 5,605,313 | 2/1997 | Erickson et al. | 248/467 |
| 5,794,903 | 8/1998 | Peterson, II | 248/300 |

*Primary Examiner*—Derek J. Berger
*Assistant Examiner*—David Heisey
*Attorney, Agent, or Firm*—Lowe Hauptman Gopstein Gilman & Berner

[57] ABSTRACT

A picture hanger is initially held in place on a wall in a temporary manner without damaging the wall by including a backing with a shock absorbing layer overlaid by a temporary adhesive film. Prior to the picture hanger being temporarily fastened to the wall, the temporary adhesive film is covered by a protective paper sheet. The shock absorbing layer prevents the wall from being indented when the hanger is permanently secured to the wall by hammering a pin or nail through the layer and film. The layer is sufficiently soft to hold the nail in place when the nail impales the layer prior to hammering the nail into the wall. Prior to the backing being secured to the hanger, the permanent adhesive film is overlaid by another removable protective sheet. Initially the backings are located on an elongated strip and are punched from the strip for mounting on the hook body.

11 Claims, 1 Drawing Sheet

STRUCTURE FOR AND METHOD OF MOUNTING AN OBJECT ON A VERTICAL SURFACE AND A LAMINATED BACKING FOR SUCH A STRUCTURE

FIELD OF INVENTION

The present invention relates generally to structure for and method of mounting an object on a vertical surface and more particularly to such a structure and method wherein a hanger member carries a temporary adhesive film and a shock absorbing layer, together enabling the structure to be easily and correctly positioned on the surface without indenting the surface except for a hole made in the surface by an elongated fastener driven against the hanger member and through the hanger member, shock absorbing layer and temporary adhesive film.

Another aspect of the invention relates to a laminated backing adapted to be secured to a hanger member for mounting an object on a vertical surface and more particularly to such a backing including a shock absorbing layer having opposed first and second faces respectively carrying (1) a temporary adhesive film overlaid by a first protective sheet and (2) a permanent adhesive film overlaid by a second protective sheet.

BACKGROUND ART

A picture hanger is one frequently used structure for mounting an object, such as a framed picture or diploma on a vertical surface, such as a wall. A typical picture hanger comprises a single piece of metal having a body from which a hook extends. Most hangers on the market have a channel through which an elongated fastener, such as a nail or pin, is inserted prior to the pin being driven into the wall. The channel on a typical hanger is not machined to be accurate and serve as a "guide" to the nail. The fastener secures the picture hanger to a wall by being driven with a hammer through the channel against the picture hanger. Because the channel is not accurately machined, it does not accurately guide the pin into the wall. Consequently, the nail or pin often shifts and moves in the channel as it is being nailed into the wall, frequently causing the wall to crack in response to the nail being hammered.

Even though millions or billions of such picture hangers have been sold and installed, certain problems exist with the use thereof. Usually two people are required to install a typical prior art picture hanger. One person holds the picture hanger at a position on the wall, while the second person decides whether the hook is located at the desired position. Installation of the typical prior art picture hanger is also cumbersome, requiring an installer to hold the hook and nail with one hand, frequently on a ladder, while holding a hammer in the other hand. When the installer is on a ladder, he or she is frequently in an unbalanced situation and is susceptible to falling, particularly as the nail or pin is being struck by the hammer.

If a picture hanger is positioned by a single person, the person must guess the approximate desired picture hanger position on the wall, then nail the picture hanger to the wall. He or she then stands back from the picture hanger and decides whether the picture hanger is correctly or incorrectly hung. If the picture hanger is not correctly hung on the wall, the person must return to the wall and then remove the hanger from the wall, leaving a hole and indentation in the wall. The person then must decide on a new position for the picture hanger and repeat the process. Frequently the process is repeated several times until a satisfactory position is found for the picture hanger. This process is time consuming and leaves many undesirable holes and indentations on the wall, causing permanent scaring and damage to the wall at several different places.

Because of difficulties in holding the picture hanger and the pin or nail in one hand and the hammer in the other hand, the installer frequently drops the pin or nail on the floor. In addition, the pin or nail is frequently bent as it is being hammered and/or enters the wall in the incorrect position because of the difficulties in holding the picture hanger and nail or pin with one hand. When the installer is on a ladder, these problems are compounded because of the need for the installer to descend, find the fastener or get a new fastener and then ascend to continue the process.

A further disadvantage of the typical prior art picture hanger is that the hanger frequently damages the wall by causing (1) a substantial indentation in the wall and/or (2) the wall surface to be scratched whereby paint or wallpaper flakes from the wall. The indentation corresponds to the shape of the hanger body and usually spans an area in excess of the hanger body. The indentation occurs in response to the hammer striking the pin or nail against the picture hanger during installation, resulting in sharp corners of the hanger base being driven into the wall. Wall scratching occurs because holding the hanger and nail with one hand and the hammer with the other hand results in the hanger and nail shifting position against the wall.

While we realize there have been numerous prior art suggestions to remedy these problems, to our knowledge none of these proposed remedies have been commercially adopted. Many of the suggested instructions for dealing with these problems have been overly complex and resulted in relatively expensive structures. Further, we are unaware of any prior art which has dealt with all three problems mentioned above, i.e., the need for two people to decide where the picture hanger should be located, the need to hold the picture hanger and pin or nail with one hand while holding a hammer in the other hand, and wall indentation.

It is, accordingly, an object of the present invention to provide a new and improved structure for and method of mounting an object on a vertical surface adapted to receive an elongated fastener.

Another object of the present invention is to provide a new and improved structure for and method of mounting an object on a vertical surface wherein the structure can easily and conveniently be installed by only one person.

An additional object of the present invention is to provide a new and improved structure for and method of mounting an object on a vertical surface adapted to receive an elongated fastener wherein the need to hold the structure while it is being secured to the surface by the fastener is obviated.

A further object of the present invention is to provide a new and improved structure for and method of mounting an object on a vertical surface adapted to receive an elongated fastener that is driven through a guide on the structure, wherein the structure is arranged to prevent wall scratching and/or indentations, other than a hole made by the fastener, in the surface.

Still a further object of the invention is to provide a new and improved, relatively inexpensive and easy to use structure for mounting an object on a vertical surface wherein an elongated fastener is held in the hand of the installer without grasping the structure and driving of the elongated fastener against the structure does not cause indentations in the vertical surface, other than a hole made by the elongated fastener.

Still another object of the invention is to provide a laminated backing adapted to be secured to a hanger for mounting an object on a vertical surface, wherein the backing is arranged so that the hanger can be temporarily secured to the vertical surface and prevents the hanger from scratching and/or indenting the surface as the hanger is driven against the surface by hammering a pin or nail through a guide of the hanger.

SUMMARY OF THE INVENTION

In accordance with one aspect of the invention, an improved structure for mounting an object on a vertical surface adapted to receive an elongated fastener comprises a backing secured to a hanger arranged to enable the fastener to pass through it into the surface. The backing includes (1) a temporary adhesive film adapted to be temporarily secured to the surface, and (2) a shock absorbing layer interposed between the hanger and the film. The layer has sufficient thickness and is made of a material such that it absorbs forces imparted by the hanger when the fastener is driven into the surface through and against the hanger. The shock absorbing layer thereby prevents the surface from being indented except for a hole made by the fastener in the surface. As a result of the backing, the structure is adapted to be (1) initially held in situ on the surface in a temporary manner without damaging the surface (e.g., wall scratching does not occur because the hanger and nail cannot slip on the wall during hammering), and (2) then held in situ by the fastener on the surface without indenting the surface when the fastener is driven into the surface to secure the structure to the surface.

Preferably, the shock absorbing layer is made of a material that is sufficiently soft to hold the fastener when the fastener is forced by hand through a guide on the hanger and impaled in the layer. As a result of the soft layer and the adhesive layer abutting the surface, an installer need not grasp either the hanger or the fastener as he or she hammers the fastener into the surface. Hence one hand of the installer is available for other purposes, for example, to grasp a ladder.

A removable sheet preferably contacts the film and is arranged to prevent contact of other objects with the film until the sheet is removed. The adhesive of the film is thereby protected prior to being secured to the surface.

Preferably the backing has a periphery corresponding with, and slightly larger than, a peripheral edge of a base of the hanger against which the backing is bonded. Because the backing shock absorbing layer extends slightly beyond the periphery base, sharp peripheral edges of the base do not dig into the surface; this assists in preventing indentations in the surface.

In the preferred embodiment the layer is secured to the hanger by a permanent adhesive film. Such an arrangement enables the backing to be sent as a laminated structure from a supplier of such backings to a fabricator of the mounting structure.

In accordance with another aspect of the invention the structure described in the previous paragraphs is secured to a vertical surface by a method that comprises (1) mounting the structure at a first location on the surface with the temporary adhesive, (2) then deciding whether the structure is in the correct location on the surface, and (3) then mounting the structure with the temporary adhesive at another location on the surface if the structure is decided to be at an incorrect location. An installer secures the structure to the correct location with the temporary adhesive when the structure is determined to be at the correct location on the surface. The structure is secured at the correct location while the temporary adhesive is holding the structure at the correct location by driving a fastener against the hanger and through the hanger, shock absorbing layer and adhesive film and into the surface without indenting the surface except for a hole made by the fastener in the surface.

Preferably the fastener is a nail (i.e., pin) and the driving step is performed by the installer hammering the nail into the surface through the hanger, shock absorbing layer and temporary adhesive film. As described supra, the adhesive film is preferably initially covered by a protective sheet that the installer removes immediately prior to the structure being mounted at the first location.

Another aspect of the invention is directed to a laminated backing adapted to be secured to a hanger for mounting an object on a vertical surface. The hanger has a base adapted to be located in a plane substantially parallel to the vertical surface when the hanger mounts the object on the surface. The backing comprises a shock absorbing layer having opposed first and second faces each having a periphery corresponding with the periphery of the hanger base. A temporary adhesive film overlaid by a first protective removable sheet is on the first face. A permanent adhesive film overlaid by a second removable protective sheet is on the second face. The hanger is adapted to be held in situ on the surface by an elongated fastener driven against and through it and through the permanent adhesive film, the shock absorbing layer and the temporary adhesive film. The shock absorbing layer has sufficient thickness and is made of a material such that it absorbs forces imparted to the hanger when the fastener is driven into the surface through and against the hanger. The layer thereby prevents the surface from being indented except for a hole made by the fastener in the surface.

For convenience in handling and manufacture, a plurality of the laminated backings are included on a single elongated strip and are adapted to be pushed from the strip leaving openings in the strip.

The above and still further objects, features and advantages of the present invention will become apparent upon consideration of the following detailed description of one specific embodiment thereof, especially when taken in conjunction with the accompanying drawings.

DESCRIPTION OF THE PREFERRED EMBODIMENT

Figure 1:
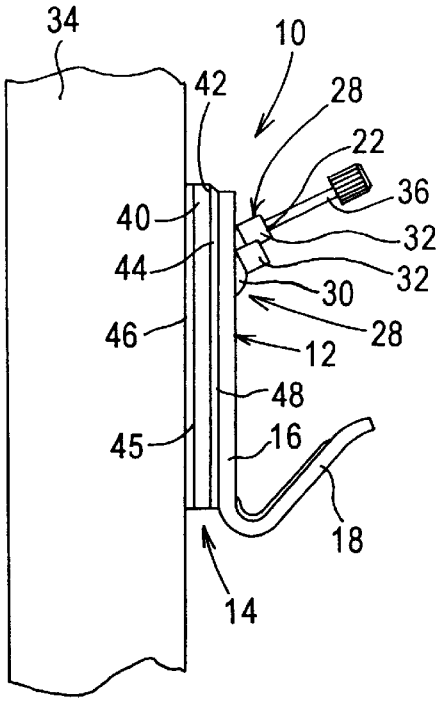
FIG. 1 is a side view of a picture hanger in accordance with the present invention, as it is about to be mounted on a wall.
Figure 2:
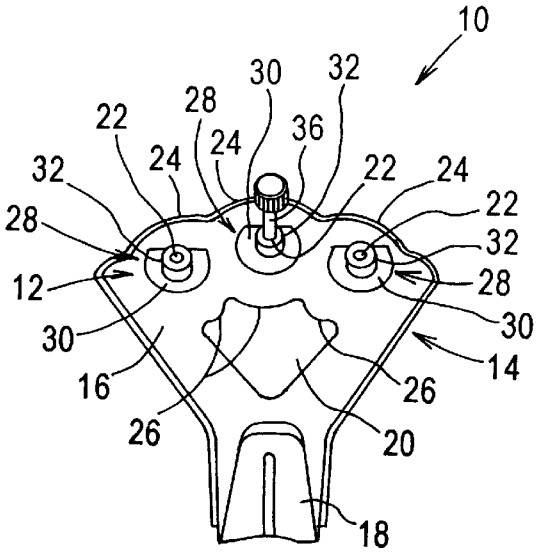
FIG. 2 is a front view of the picture hanger of FIG. 1.

Reference is now made to FIGS. 1 and 2 of the drawing wherein a support structure 10 includes a one-piece metal picture hanger member 12 carrying backing 14. Conventional metal hanger member 12 includes a substantially planar base 16 from which hook 18 extends. Base 16 preferably has a generally triangular shape, center opening 20, and three circular pin or nail receiving accurately machined guide holes 22, generally aligned with scallops 24 at the top of member 16. Each of holes 22 is machined to have a diameter only slightly greater than the diameter of elongated fasteners 36, usually pins or nails, that are driven by a hammer through openings 22 and backing 14 to mount hanger 10 on nailable wall 34. A snug fit is thereby provided between fasteners 36 and guide holes 22 to accurately hold the fastener in situ during hammering, in contrast to the typical prior art channel arrangement. While picture hangers having accurately machined nail receiving guide holes are known, the use of such guide holes in the present invention further assists in enabling the hanger to be accurately positioned without causing wall damage. Opening 20 includes corresponding scallops 26 in the center of member 16 beneath openings 22. Openings 22 extend through corresponding aligned openings in body 16 and guides 28 formed by hemispheres 30, each carrying a cylinder 32.

In the prior art, which did not include backing 14, elongated fastener 36 was driven only through openings 22 into wall 34, causing the problems mentioned in the Background Art portion of this specification. In particular, many installers have difficulties in holding metal piece 12 and fastener 36 in one hand while driving a hammer against the fastener with the other hand. The two handed operation often results in wall scratching. In addition, wall 34 has a tendency to be indented about the periphery of base 16. Further, two people are usually necessary to install the hanger, one holding it and the other standing back a distance for observation purposes.

In accordance with the present invention, backing 14 avoids these prior art problems. In the preferred embodiment, backing 14 includes shock absorbing layer 40, preferably made of relatively soft rubber or relatively soft foam and having a substantial thickness, in the range of 1/16th to 1/8th of an inch. Layer 40 is soft and thick enough to hold nail 36 in situ when the nail is manually driven by an installer into the layer in such a way as to cause the nail to impale the layer but not be driven into wall 34.

One face 42 of shock absorbing layer 40 is permanently bonded to permanent adhesive film 44 that permanently connects shock absorbing layer 40 to back face 48 of base 16 to permanently bond layer 40 and body 16 to each other. Temporary adhesive film 46, preferably the same type of adhesive as used in POST-IT notes, is permanently attached to face 45 of shock absorbing layer 40. Face 45 is parallel to and opposite from face 42.

To install picture hanger 10 on wall 34, an installer places the tacky face of temporary adhesive film 46 against wall 34. Then the installer moves away from the wall and decides if hanger 10 is at the correct position. If the installer decides hanger 10 is not at the correct position, he/she merely removes the hanger from wall 34 without damaging any part of the wall because of the temporary bond between film 46 and wall 34. When the installer decides hanger 10 is correctly positioned on wall 34, he/she grasps fastener pin or nail 36 and manually drives fastening pin or nail 36 through opening 22 and backing 14 into wall 34. Layer 40 holds the nail to enable the installer to look again at the hanger from a distance. If the installer decides the hanger is correctly located, he/she hammers nail 36 without necessarily holding either the nail or member 12. Because backing 14 extends slightly beyond the periphery of base 16, as illustrated in FIG. 2, and because of the shock absorbing properties of layer 40, wall 34 is not indented or damaged in any way by pin or nail 36 being hammered against the top exposed face of cylinder 32. The installer need not hold hanger 12 nor nail 36 because the hanger is temporarily bonded to wall 34 by temporary adhesive film 46 and nail 36 is held by layer 40. The temporary bond, layer 40 and the tight fit of nail 36 in guide hole 22 prevent shifting of hanger 12 and nail 36 during hammering to prevent scratching of wall 34.

Figure 3:
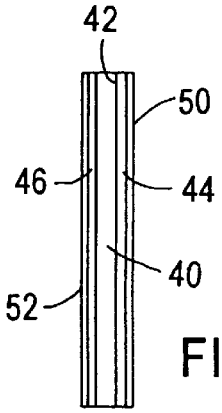
FIG. 3 is a side view of a backing for the picture hanger of FIGS. 1 and 2, wherein the backing is illustrated prior to being permanently secured to a body of the hanger and prior to the hanger being installed on a wall.

To prevent films 44 and 46 of backing 14 from adhering to other objects prior to installation on hanger 12 and wall 34, the faces of permanent adhesive film 44 and temporary adhesive film 46 opposite from faces 42 and 45 of shock absorbing layer 44 are respectively covered with protective removable paper sheets 50 and 52 as illustrated in FIG. 3. Protective removable paper sheets 50 and 52, in addition to preventing adhesive films from adhering to undesirable surfaces, also retain the tackiness of these films.

Immediately prior to backing 44 being permanently secured to metal hanger 12, protective removable paper sheet 50 is pulled from permanent adhesive film 44. Adhesive film 44 is then secured to back face 48 of body 16. Structure 10 is sold in this manner to retailers and consumers.

Protective removable paper sheet 52 is removed from temporary adhesive film 46 by the installer immediately prior to the installer mounting hanger 10 on wall 34. After sheet 52 has been removed from temporary adhesive film 46 the installer temporarily and then permanently mounts hanger 10 on wall 34 as described supra. Because soft layer 40 holds fastener 36 in place ready for hammering and film 46 holds hanger 12 in situ, there is no need for the installer to hold the nail or the hanger with his hand. The nail is held in place by the adhesive soft shock absorbing layer 40 and the hanger stays in place by the force of adhesive film 46 on wall 34. The installer, even after manually pushing the fastener 36 into soft shock absorbing layer 40, can remove hanger 10 from wall 34 without damaging the wall. Because there is no need for the installer to hold either fastener 44 or hanger 10 while hammering the fastener into the wall, the installer can grasp a supporting structure such as a ladder, if necessary or desired. Because wall 34 does not come in contact with sharp corners of metal piece 12, but only with the relatively soft backing, no scoring or other damage to the wall occurs, except for the small hole resulting from fastener 36 being driven into it.

Figure 4:
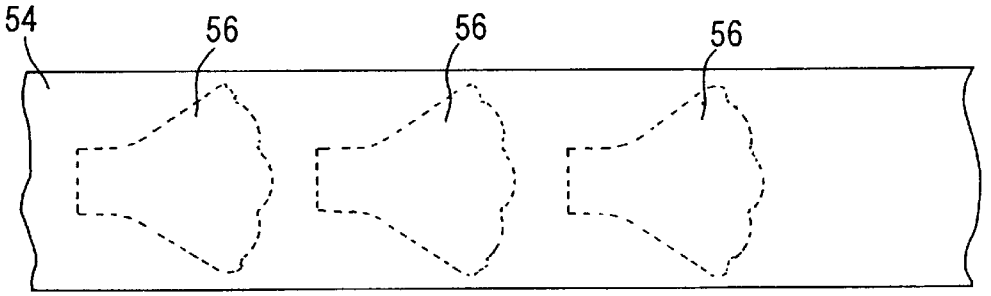
FIG. 4 is a front view of an elongated strip with several perforated areas including the backing illustrated in FIG. 3.

As illustrated in FIG. 4, backing 10 is preferably included on an elongated strip 54 shipped from the manufacturer of the laminated backing structure to a fabricator of support structure 10 who has an inventory of metal hangers 12. The fabricator has the strips die cut to correspond to the areas of base 16, without removing the die cut regions from strip 54. Then protective sheet 50 is removed immediately before back faces 48 of bases 16 of hangers 12 are pushed against permanent adhesive film 44 of individual backing members 56 on strip 54. The individual members 56 are thereby bonded to hangers 12 to form support structures 10 which are removed from the remainder of the strip merely by being pushed from the strip.

While there has been described and illustrated one specific embodiment of the invention, it will be clear that variations in the details of the embodiment specifically illustrated and described may be made without department from the true spirit and scope of the invention as defined in the appended claims.

We claim:

1. A structure for mounting an object on a vertical surface adapted to receive an elongated fastener, the structure being adapted to be initially held in situ on the surface in a temporary manner without damaging the surface and then being adapted to be held in situ by the fastener on the surface without indenting the surface when the fastener is driven into the surface to secure the structure to the surface, the structure comprising a hanger arranged to enable the fastener to pass through it into the surface, a backing secured to the hanger, the backing including (a) a temporary adhesive film adapted to be temporarily secured to the surface, and (b) a shock absorbing layer interposed between the hanger and the film, the layer extending slightly beyond a peripheral edge of a base of the hanger and having sufficient thickness and being made of a material such that it absorbs forces imparted by the hanger when the fastener is driven into the surface through and against the hanger.

2. The structure of claim 1 wherein the shock absorbing layer is made of a material that is sufficiently soft to hold the fastener when the fastener is impaled in the layer.

3. The structure of claim 2 further including a removable sheet contacting the film and arranged to prevent contact of other objects with the film until the sheet is removed, whereby the adhesive of the film is protected prior to being secured to the surface.

4. The structure of claim 3 wherein the layer is permanently secured to the hanger by a permanent adhesive film.

5. The structure of claim 1 wherein the layer is permanently secured to the hanger member by a permanent adhesive film.

6. The structure of claim 1 further including a removable sheet contacting the film and arranged to prevent contact of other objects with the film until the sheet is removed, whereby the adhesive of the film is protected prior to being secured to the surface.

7. The structure of claim 1 wherein the layer is constructed and arranged to substantially prevent the surface from being indented except for a hole made by the fastener in the surface.

8. A method of securing an object to a vertical surface with a structure including a hanger carrying a backing including (a) a temporary adhesive film adapted to be temporarily secured to the surface, and (b) a shock absorbing layer interposed between the hanger and the film, the surface being adapted to receive an elongated fastener, the method comprising mounting the structure at a first location on the surface with the temporary adhesive, then deciding whether the structure is in the correct location on the surface, then mounting the structure with the temporary adhesive at another location on the surface if the structure is decided to be at an incorrect location, securing the structure to the correct location with the temporary adhesive when the structure is determined to be at the correct location on the surface, the structure being secured at the correct location while the temporary adhesive is holding the structure at the correct location by driving a fastener against the hanger and through the (a) hanger, (b) shock absorbing layer and (c) adhesive film and into the surface, the shock absorbing layer being soft enough to hold the fastener in place, and manually inserting the fastener into the layer so the fastener impales the layer and is held in situ in the hanger without the fastener being driven into the surface.

9. The method of claim 8 wherein the driving step is performed by hammering the elongated fastener into the surface through (a) the hanger, (b) shock absorbing layer and (c) temporary adhesive film.

10. The method of claim 9 wherein the adhesive film is initially covered by a protective sheet, and removing the protective sheet immediately prior to the structure being mounted at the first location.

11. The method of claim 8 wherein the adhesive film is initially covered by a protective sheet, and removing the protective sheet immediately prior to the structure being mounted at the first location.

* * * * *